United States Patent [19]

Jaworski et al.

[11] 4,248,202

[45] Feb. 3, 1981

[54] DISC LAUNCHER

[75] Inventors: Eugene Jaworski, Park Ridge; Jeffrey D. Breslow, Highland Park, both of Ill.

[73] Assignee: Marvin Glass & Associates, Chicago, Ill.

[21] Appl. No.: 968,125

[22] Filed: Dec. 11, 1978

[51] Int. Cl.[3] ..... F41B 7/08

[52] U.S. Cl. ..... 124/16; 124/36; 124/42; 124/50

[58] Field of Search ..... 124/16, 36, 41 R, 42, 124/50, 49, 43, 21, 47, 51 R; 273/129 HA, 129 HB, 1 B; 221/276, 271

[56] References Cited

U.S. PATENT DOCUMENTS

| | | | |
|---|---|---|---|
| 1,818,763 | 8/1931 | Shigley | 124/42 X |
| 2,711,726 | 6/1955 | Darrell | 124/47 X |
| 3,191,588 | 6/1965 | Thew | 124/42 X |
| 3,515,114 | 6/1970 | Carbonneau | 124/42 UX |
| 3,779,227 | 12/1973 | Scott | 124/16 |
| 3,838,677 | 10/1974 | Alvares | 273/1 B X |
| 3,876,201 | 4/1975 | King | 124/42 X |

*Primary Examiner*—William R. Browne

*Attorney, Agent, or Firm*—Mason, Kolehmainen, Rathburn & Wyss

[57] ABSTRACT

A toy launcher of a safe and simple construction for use in propelling soft, round discs includes a round or saucer shaped housing with an integrally formed handle for engagement by an operator's hand and a two position, manually operable actuating arm for moving a disc from a loading position to a firing position and for simultaneously placing a spring actuated firing mechanism in a firing position under the control of a trigger mechanism. After positioning a disc in the disc firing position, the actuating arm is returned to the disc loading position both to position another disc in the disc loading position and to clear a launching slot in the launcher to enable the disc in the disc firing position to be propelled. The actuating arm includes an arcuately shaped elongated portion extending rearwardly from a curved disc engaging portion for preventing discs loaded in a supply magazine positioned above the actuating arm from being fed by gravity into the disc loading position unless the actuating arm is positioned in the disc loading position. An annular track is disposed wholly within the launcher for internally restricting the movement of the spring loaded firing mechanism to prevent any portion of the firing mechanism from accidentally contacting the operator of the toy launcher.

18 Claims, 4 Drawing Figures

DISC LAUNCHER

BACKGROUND OF THE INVENTION

A. Field of the Invention

The device of the present invention generally relates to toy projectile launchers and, more particularly, to a hand held toy launcher for propelling disc projectiles therefrom.

B. Description of the Prior Art

Toy projectile launchers are old and well known in the toy art. Both adults and children throughout the years have been provided with many hours of pleasant entertainment by the many different types of commercially available toy launchers. Examples of prior art toy launchers are depicted in U.S. Pat. Nos. 3,044,213, 3,717,136 and 4,076,006. While such prior art toy launchers are capable of entertaining their operators, the toy launcher illustrated in U.S. Pat. No. 4,076,006 is not readily suitable for being held, aimed and fired by one hand of an operator; and the toy launchers illustrated in U.S. Pat. Nos. 3,044,213 and 3,717,136 have relatively complex and, subsequently, expensive designs.

A further drawback of the toy disc launcher illustrated in U.S. Pat. No. 3,717,136 is the manner in which the disc disclosed therein is held in its firing position until it is fired. Thus, if a disc is loaded into the firing position and the launcher is put down prior to firing for a period of nonuse, an operator may subsequently accidentally trigger the launcher and fire the disc while being unaware that a disc had been loaded in the firing position.

SUMMARY OF THE INVENTION

An object of the present invention is to provide a new and improved toy launcher.

Another object of the present invention is to provide a new and improved toy disc launcher.

Another object of the present invention is to provide a new and improved toy disc launcher having a very safe and simple construction and capable of being held, aimed and fired by one hand of an operator.

Another object of the present invention is to provide a new and improved toy disc launcher that utilizes a pair of stops and the force of gravity alone for maintaining a disc in a firing position, thereby rendering highly unlikely the accidental discharge of a disc from the launcher after a period of nonuse.

Another object of the present invention is to provide a new and improved toy disc launcher having a movable, two position actuating arm for transferring a disc from a loading position to a firing position and for preventing both the firing of the disc in the firing position and the positioning of another disc in the loading position until the actuating arm is returned to the disc loading position.

Briefly, a new and improved toy launcher adapted for projecting disc projectiles formed, in the preferred embodiment, from a lightweight, soft, flexible, porous or spongy material, includes a generally round or saucer shaped housing with an integrally formed handle that enables an operator to hold, aim and fire the launcher with one hand. The launcher includes a two position actuating arm that, in a disc loading position, receives a disc from a gravity fed supply magazine positioned above the generally arcuately shaped path of the actuating arm and that is manually operable to move the disc from the disc loading position to a disc firing position. In the latter position, the actuating arm both positions the disc to be fired against two stops and simultaneously sets a spring biased firing mechanism and an elastically biased trigger mechanism.

In the disc firing position, the actuating arm prevents the firing of the disc both by blocking a launching slot through which the disc is projected from the launcher and by preventing the movement of the firing mechanism. In addition, an arcuately shaped, elongated portion of the actuating arm that extends rearwardly from a curved disc engaging portion of the arm extends across and blocks the outlet of the disc supply magazine to prevent a disc in the magazine from entering the path of the actuating arm unless the arm is in the disc loading position. An elastically biased trigger may be released by a finger of the operator to release the firing mechanism to cause the disc in the firing position to be eccentrically propelled from the launcher through the launching slot along a path of travel angularly disposed to the longitudinal axis of the housing of the launcher.

The toy launcher includes an annular track disposed wholly within the housing of the launcher for internally restraining the movement of a free arm of a spring used, in the preferred embodiment, as the firing mechanism. Further, the accidental firing of a disc from the toy launcher after a period of nonuse is highly unlikely since the launcher utilizes two stops and the force of gravity alone to maintain a disc in the disc firing position. If the toy launcher is put down by an operator, it is most likely that a disc previously positioned in the firing position will fall out of the launching slot of the launcher or at least become displaced from the firing position.

Thus, the new and improved toy launcher disclosed herein is designed to provide many hours of enjoyable and safe entertainment for children and adults alike.

BRIEF DESCRIPTION OF THE DRAWING

The above and other objects and advantages and novel features of the present invention will become apparent from the following detailed description of the preferred embodiment of the present invention as illustrated in the accompanying drawing wherein.

DESCRIPTION OF THE PREFERRED EMBODIMENT

Figure 1:
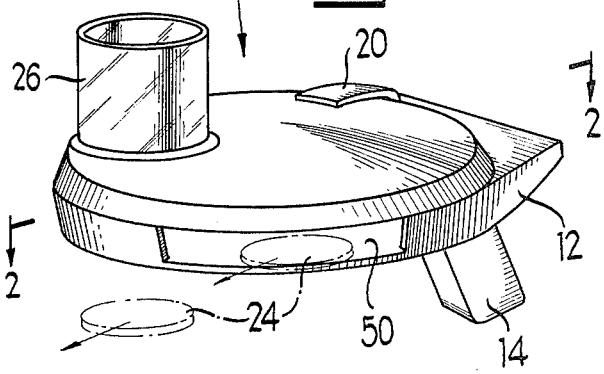
FIG. 1 is a perspective view of a toy launcher constructed in accordance with the principles of the present invention.
Figure 2:
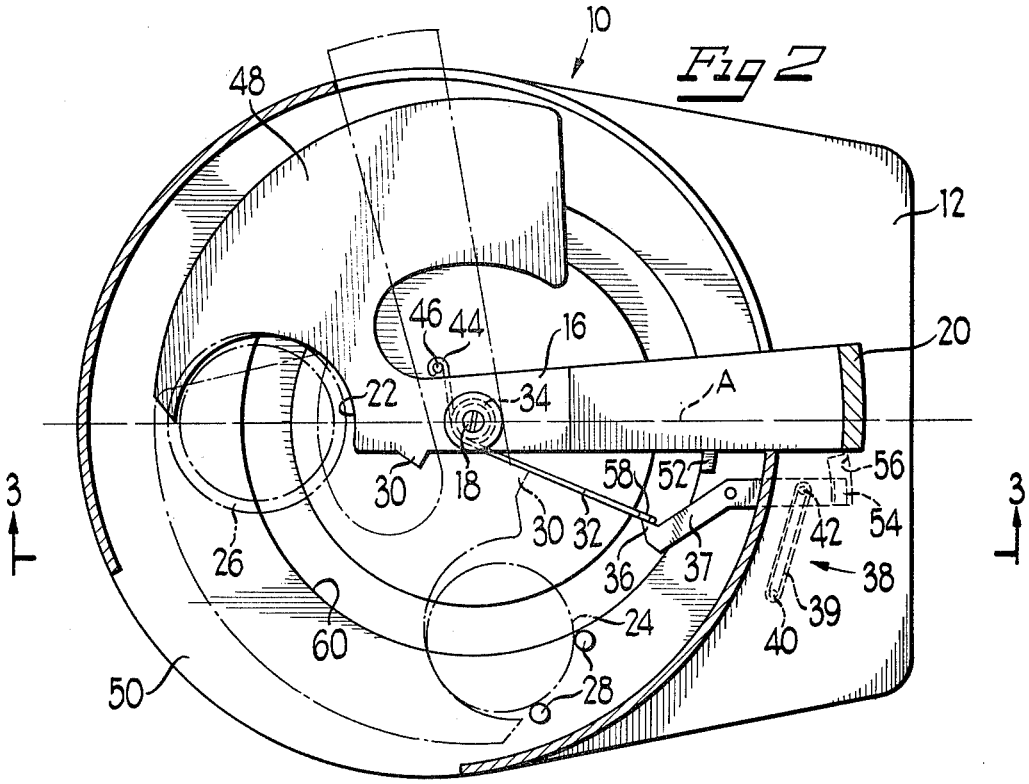
FIG. 2 is an enlarged, cross-sectional view of the toy launcher of FIG. 1 taken along line 2—2 of FIG. 1.
Figure 3:
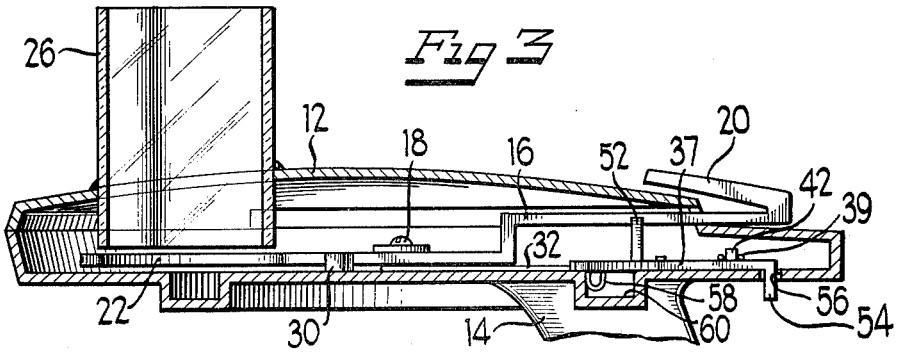
FIG. 3 is an enlarged, cross-sectional view of the toy launcher of FIG. 1 taken along line 3—3 of FIG. 2.

In accordance with an important feature of the present invention, a new and improved toy launcher 10 (FIGS. 1–3) of a safe and simple construction includes a generally round or saucer shaped housing 12, that in the preferred embodiment is formed from a suitable moldable synthetic resin, with an integrally formed handle 14 designed to enable the launcher 10 to be held, aimed and fired by one hand of an operator. The round or saucer shaped configuration of the housing 12 imparts a futuristic or space age appearance to the launcher 10 that increases the appeal and enjoyment of the toy launcher 10 to the operator. The launcher 10 includes a two position actuating arm 16 that is pivotably movable about a screw 18 along a generally arcuately shaped path from a disc loading position (shown in solid lines in FIG. 2) to a disc firing position (shown in phantom lines in FIG. 2). An integrally formed, externally disposed portion 20 of the arm 16 is engageable by a hand of an operator to impart movement to the arm 16.

Figure 4:
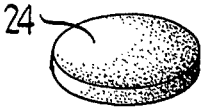
FIG. 4 is an enlarged, perspective view of a preferred embodiment of a disc projectle designed for use with the toy launcher of FIG. 1.

The arm 16 includes a curved leading edge portion 22 for engaging a disc 24 (FIG. 4) and for moving the disc 24 from the disc loading position to the disc firing position. In the preferred embodiment, the disc 24 is formed from a lightweight, soft, flexible, spongy or porous material, for example, foamed polyurethane, to minimize the possibility of damage to any object contacted by the disc 24 after projection from the launcher 10. In the disc loading position, the arm 16 enables a disc 24 to be received from a tubularly shaped supply magazine 26 disposed above the arcuate path of the arm 16. The magazine 26 is designed to receive and store a plurality of discs 24 and to utilize the force of gravity to automatically serially feed discs 24 into the disc loading position when the arm 16 is disposed in the disc loading position.

After receiving a disc 24 from the magazine 26, the arm 16 may be manually moved to place the disc 24 in the firing position against a pair of rigid or fixed stops 28 secured to the housing 12. Simultaneously, an integrally formed, outwardly projecting portion 30 of the arm 16 engages and moves a free arm 32 of a coiled spring 34, the firing mechanism of the launcher 10, until the free arm 32 is disposed behind and engaged by a projecting edge portion 36 of an elastically biased, pivotably movable trigger 37 of the trigger mechanism 38. In the preferred embodiment, the trigger 37 is biased by a rubberband 39 (shown in phantom lines in FIG. 2) disposed about a fixed stop 40 and a stop 42 integrally formed on a portion of the trigger 37. A fixed end 44 of the spring 34 is disposed about a fixed stop 46 secured to the housing 12.

The actuating arm 16 includes an arcuately shaped, elongated portion 48 that extends rearwardly from the curved leading edge portion 22 of the arm 16 for blocking the outlet of the magazine 26 to thereby prevent the transfer of a disc 24 from the magazine 26 to the disc loading position if the arm 16 is not positioned in the disc loading position. The arm 16 (FIG. 2) also prevents the launcher 10 from projecting a disc 24 therefrom while the arm 16 is in the disc firing position. The elongated portion 48 effectively blocks a launching slot 50 through which discs 24 are propelled from the launcher 10; and the projecting portion 30 of the arm 16 in contact with the free arm 32 of the spring 34 prevents the movement of the free arm 32 and, thus, the operation of the firing mechanism of the launcher 10.

To fire the launcher 10, the arm 16 is moved to its disc loading position against a fixed stop 52 secured to the housing 12. The trigger 38 may then be manually operated by the engagement of an integrally formed, trigger release portion 54 that extends from the trigger 37 downwardly and exteriorly of the housing 10 through a slot 56 formed in the housing 10. By moving the trigger release portion 54 laterally against the bias of the rubberband 39, the projecting edge portion 36 is pivoted away from and out of contact with a downwardly projecting generally U-shaped end 58 of the free arm 32 of the spring 34 to thereby actuate the firing mechanism of the launcher 10. The end 58 of the arm 32 is located in an annular track 60 that is disposed wholly within the housing 12 and that internally restrains the movement of the U-shaped end 58 and the free arm 32 to prevent those portions of the firing mechanism from contacting an operator externally of the housing 12.

The path of the U-shaped end 58 of the free arm 32 of the spring 34 is designed to permit the end 58 to contact an outer peripheral portion of a disc 24 positioned against the stops 28 in such a manner as to eccentrically propel the disc 24 through the launching slot 50 and away from the launcher 10 along a generally forwardly directed path of travel disposed at an acute angle to a central longitudinal axis "A" (FIG. 2) of the housing 12 of the launcher 10. For example, the angle may be in the range of 10°–80° and, preferably, is approximately 33°.

The accidental firing of a disc 24 from the launcher 10 after a period of nonuse is highly unlikely since the launcher 10 merely utilizes the two stops 28 and the force of gravity alone to maintain the disc 24 in the disc firing position. If the launcher 10 is put down by an operator, it is most unlikely that a disc 24, previously positioned in the disc firing position, will remain in that position. Normally, the disc 24 in such an instance will fall through the launching slot 50 and out of the launcher 10 or at least become displaced from the disc firing position.

Obviously, many modifications and variations of the present invention are possible in light of the above teachings. For example, to provide a longer flight, the disc 24 could be made with a hole in the center or be made of a more rigid, higher density and, thus, heavier material than that set forth hereinabove. In addition, by adjusting the locations of the stops 28, of the firing mechanism, that is, the coiled spring 34, of the trigger mechanism 38 and, possibly, of the launching slot 50, the angular direction of the path of travel of the disc 24 from the launcher 10 may be modified. Specifically, the angular direction could be modified to provide a path of travel of the disc 24 that is parallel to, but spaced from, the central longitudinal axis "A" of the housing 12 of the launcher 10.

Finally, alternate embodiments of the firing and trigger mechanisms disclosed herein will be apparent to those skilled in the art after reviewing the above teachings. Thus, it is to be understood that, within the scope of the appended claims, the invention may be practiced otherwise than as specifically described above.

What is claimed and desired to be secured by Letters Patent of the United States is:

1. A toy launcher for propelling generally disc-shaped projectiles therefrom comprising:

a housing;

a generally tubularly shaped magazine extending from said housing for retaining one or more disc projectiles, said magazine having an outlet disposed above a loading position;

a rotatable actuating means disposed at least partially within said housing and movable along an arcuate path of travel between at least two positions for engaging and moving a projectile from said loading position to a firing position, said rotatable means including a leading edge portion for engaging a projectile and means for preventing the movement of a projectile from said magazine to said loading position, said movement preventing means comprising an elongated portion extending rearwardly from said leading edge portion along said arcuate path of travel and extending across at least a portion of said outlet of said magazine; and firing means for imparting force to said projectile to launch a projectile from said launcher.

2. A toy launcher as recited in claim 1 wherein said housing comprises a saucer shaped housing and includes integrally formed means for enabling said launcher to be held, aimed and fired by one hand of an operator.

3. A toy launcher as recited in claim 1 further comprising a trigger means releasably engageable with said firing means, said firing means comprising a spring having an elongated free arm extending therefrom and adapted to be engaged by said actuating means for moving said free arm into engagement with said trigger means to thereby bias said spring.

4. A toy launcher as recited in claim 3 wherein said trigger means includes manually operable trigger release means for releasing said free arm of said spring to thereby enable said free arm to contact an outer peripheral portion of a disc projectile and to thereby propel a disc projectile from said launcher.

5. A toy launcher as recited in claim 4 wherein said housing includes means for internally restraining the movement of said free arm of said spring within said housing, said internally restraining means comprising an annular track disposed wholly within said housing.

6. A toy launcher as recited in claim 1 further comprising means for retaining a disc projectile in said other position, said retaining means comprising a pair of fixed stops.

7. A toy launcher for propelling disc-like projectiles therefrom, comprising:

a housing;

rotatable loading means disposed at least partially within said housing for moving a disc-like projectile along a first path of travel from a loading position to a launching position to be propelled from said launcher; and propelling means is cocked in response to movement of said loading means within said housing to enable said propelling means to store energy to enable it to propel a disc projectile, positioned in said launching position, to be propelled from said launcher along a second path of travel.

8. A toy launcher as recited in claim 7 wherein said first path of travel is an arcuate path of travel.

9. A toy launcher as recited in claim 8 wherein an acute angle defined by said arcuate path of travel is in the range of about 90°.

10. A toy launcher as recited in claim 7 further comprising a generally tubularly shaped magazine at least partially extending above said housing for retaining one or more disc-like projectiles, said magazine having an outlet disposed above a portion of the path of travel of said propelling means.

11. A toy launcher for propelling disc projectiles therefrom comprising a housing having rotating means disposed at least partially within said housing and movable along a first arcuate path of travel between at least two positions, and said rotating means moving a projectile from a projectile receiving position to a projectile launching position, a generally tubularly shaped magazine at least partially extending above said housing for retaining one or more disc projectiles, said magazine having an outlet disposed above said one position, a disc projectile adapted to be propelled from said launcher, firing means for propelling said disc projectile from said launcher, trigger means at least partially disposed within said housing releasably engageable with said firing means and a pair of fixed stops secured to said housing for stopping said disc projectile at said other position, said actuating means including means for physically contacting said firing means to place said firing means into releasable engagement with said trigger means.

12. A toy launcher as recited in claim 11 wherein said rotating means includes a leading edge portion for engaging a disc projectile and means for preventing the movement of a disc projectile from said magazine to said projectile receiving position when said rotating means is in said projectile launching position, said movement preventing means comprising an elongated portion integrally formed with and extending rearwardly from said leading edge portion along said first path of travel and across at least a substantial portion of said outlet of said magazine.

13. A toy launcher for propelling projectiles therefrom, comprising:

a housing;

means for feeding a plurality of projectiles into said housing;

rotatable projectile transfer means adjacent said feeding means for transferring a projectile therefrom to a launching position;

firing means for propelling a projectile from said launcher, said transfer means engaging the firing means during transfer of a projectile to the launching position for moving the firing means from an unbiased condition to a biased position; and trigger means adjacent the launching position for releasably engaging said firing means and maintaining said firing means in its biased condition, said trigger means comprising a pivotally mounted latch mechanism for latching said firing means in said biased condition, said latch mechanism being manually actuatable by a user of the device for releasing the firing means to launch a projectile from the launcher.

14. A toy launcher as recited in claim 13 wherein said transfer means moves projectiles through an arc of approximately 90°.

15. A toy launcher as recited in claim 13 wherein said housing comprises a substantially round structure with an integrally formed handle to enable the launcher to be held, aimed and fired by one hand of an operator.

16. A toy launcher for propelling disc-like projectiles therefrom, comprising:

a housing;

pivotable firing means for launching a projectile from the launcher;

pivotable cocking means disposed at least partially within said housing for positioning, by pivotal movement in one direction, a disc projectile adjacent said firing means into a position to be propelled from said launcher and for simultaneously biasing said firing means to a firing position; and trigger means for latching said firing means in the biased position, said trigger means being actuatable to release said firing means upon reverse movement of said cocking means.

17. A toy launcher for propelling disc-like projectiles therefrom, comprising:

a housing;

rotatable means disposed at least partially within said housing for positioning a disc-like projectile in a position to be propelled from said launcher; and propelling means within said housing for propelling a disc projectile from said launcher along a path of travel, said propelling means comprising a firing means disposed within said housing and trigger means at least partially disposed within said housing and releasably engageable with said firing means, said firing means comprising a spring for impacting on a projectile and said spring having a longitudinally extending free arm and said rotatable positioning means rotating and engaging said free arm, during movement of a projectile to a launching position, to position said free arm in restraining contact with said trigger means to thereby bias the spring.

18. A toy launcher as recited in claim 17 wherein said trigger means includes manually operable trigger release means for releasing said free arm of said spring to enable said free arm to contact an outer peripheral portion of a disc projectile for propelling a disc projectile from said launcher.

* * * * *